United States Patent [19]

Suto et al.

[11] Patent Number: 4,898,723

[45] Date of Patent: Feb. 6, 1990

[54] METHOD FOR PRODUCING HIGH STRENGTH, HIGH MODULUS MESOPHASE-PITCH BASED CARBON FIBERS

[75] Inventors: Yoshinori Suto; Toshiyuki Ito; Hideyuki Nakajima; Keiichiro Okamura; Shin-ichi Nayuki, all of Kamisumachi; Hiroyasu Ogawa; Harumitsu Enomoto, both of Shizuokaken, all of Japan

[73] Assignee: Petoca Ltd., Tokyo, Japan

[21] Appl. No.: 202,851

[22] Filed: Jun. 3, 1988

[30] Foreign Application Priority Data

Jun. 5, 1987 [JP] Japan ..... 62-139979

[51] Int. Cl.[4] ..... D01F 9/12

[52] U.S. Cl. ..... 423/447.4; 423/447.1; 423/447.2; 423/447.6; 423/448; 264/29.2

[58] Field of Search ..... 423/447.1, 447.2, 447.4, 423/447.6, 448; 264/29.2

[56] References Cited

U.S. PATENT DOCUMENTS

| | | | |
|---|---|---|---|
| 3,775,520 | 11/1973 | Ram et al. | 423/447.1 |
| 3,976,746 | 8/1976 | Wizon | 423/447.8 |
| 4,100,004 | 7/1978 | Moss et al. | 423/447.2 |
| 4,314,981 | 2/1982 | Miyamori et al. | 264/29.2 |
| 4,452,860 | 6/1984 | Obama et al. | 423/447.1 |
| 4,609,540 | 9/1986 | Izumi et al. | 423/447.2 |
| 4,610,860 | 9/1986 | Mullen | 423/447.6 |
| 4,656,022 | 4/1987 | Uemura et al. | 423/447.2 |
| 4,671,950 | 6/1987 | Ogawa et al. | 423/447.1 |
| 4,705,618 | 11/1987 | Tsuchitani et al. | 423/447.1 |

FOREIGN PATENT DOCUMENTS

| | | | |
|---|---|---|---|
| WO85/01752 | 4/1985 | PCT Int'l Appl. | 264/29.2 |

*Primary Examiner*—Robert L. Stoll
*Assistant Examiner*—Robert M. Kunemund
*Attorney, Agent, or Firm*—Armstrong, Nikaido, Marmelstein, Kubovcik & Murray

[57] ABSTRACT

A method for producing mesophase pitch based carbon fibers which enables to produce high strength high modulus carbon fibers at a relatively low temperature with stabilized production manner. This method comprises carbonizing infusibilized fibers, in an inert atmosphere under no tension state or a tension of 1 mg/denier or less in the first stage to give a specified interlayer spacing and a crystallite thickness and then carbonizing under a tension of 50–300 mg/denier at a temperature of 2600° C. or more in the second stage.

1 Claim, No Drawings

METHOD FOR PRODUCING HIGH STRENGTH, HIGH MODULUS MESOPHASE-PITCH BASED CARBON FIBERS

BACKGROUND OF THE INVENTION

(Field of Art)

This invention relates to a method for producing high strength, high modulus mesophase-pitch-based carbon fibers. More particularly, it relates to a method for producing high strength, high modulus carbon fibers having a tensile modulus of elasticity of 75,000 Kgf/mm$^2$ or more and a tensile strength of 250 Kgf/mm$^2$ or more and yet containing extremely small number of fluffs.

(Prior Art)

A method for producing pitch based carbon fibers from petroleum pitch of residual carbonaceous material by-produced from thermal catalytic cracking (FCC) of vacuum gas oil or thermal cracking of naphtha has heretofore been well known. Carbon fibers have been used widely in various kinds of application field such as aeronautic and space construction materials and sporting articles, etc., due to their various excellent properties such as mechanical, chemical and electric properties and their lightness.

Particularly, mesophase pitch based carbon fibers, differently from the carbon fibers produced from organic-polymer-based fibers such as PAN, provide easily high modulus of elasticity of 50,000 Kgf/mm$^2$ or more by carbonization-graphitization treatment without applying tension.

However, since a graphitization temperature necessary for producing high modulus carbon fibers having a tensile modulus of elasticity of 75,000 Kgf/mm$^2$ or more under such a low tension state as being called to be practically tensionless state, is so high as close to 3000° C., defects due to sublimation of carbon and to strain caused by the development of graphite crystal, etc. increase and only carbon fibers having a low tensile strength are obtained. Further as an apparatus for obtaining a high temperature as above-mentioned, a graphitization furnace in which a carbon material is used as furnace elements, is utilized. Even if much higher modulus of elasticity is sought for, it is deemed to be extremely difficult to obtain carbon fibers having super high modulus of elasticity over 75,000 Kgf/mm$^2$ in stabilized way on account of increase of vapour pressure of carbon.

On the other hand, it is disclosed in the official gazette of Japanese (examined) patent publication No. 10254 of 1972 that application of tension at the time of carbonization of isotropic pitch increases tensile modulus of elasticity of fibers. But, according to the investigation of the present invention application of tension to pitch based fibers at a low temperature is liable to cause fluffs and attainable levels of a tensile strength and a tensile modulus of elasticity are 150 Kgf/mm$^2$ and 25,000 Kgf/mm$^2$, respectively, at the utmost and it has also been found that bundles of fibers are inferior in processability due to creation of a large amount of fluffs.

The inventors of the present invention have made comprehensive investigation in order to overcome the drawbacks of the above-mentioned prior art and completed the present invention.

It is an object of the present invention to provide a stabilized method for producing mesophasebased carbon fibers having a tensile strength of 250 Kgf/mm$^2$ or more and a tensile modulus of elasticity of 75,000 Kgf/mm$^2$ or more and containing extremely small number of fluffs.

SUMMARY OF THE INVENTION

The present invention resides in a method for producing high strength, high modulus carbon fibers which is characterized in carbonizing infusiblized fibers in an inert atmosphere, in the first stage, under no tension state or a tension of 1 mg/denier or less until an interlayer spacing d 002 of 0.3460–0.3490 nm and a crystallite thickness Lc (002) of 1.6–2.2 nm are attained and then, in the second stage, under a tension of 50–300 mg/denier at a temperature of 2600° C. or more for from several seconds to several minutes.

DESCRIPTION OF THE PREFERRED EMBODIMENT

Raw materials for the mesophase pitch in the present invention include residual oil of atmospheric distillation of petroleum oil, residual oil of vacuum distillation of petroleum oil, residual oil of thermal catalytic cracking of gas oil, petroleum based heavy oils such as pitch, coal based heavy oil such as coal tar and coal liquidized product. Pitch containing 100% mesophase can be produced by heat-treating the above-mentioned raw materials in the non-oxidative atmosphere to produce mesophase, allowing the mesophase to grow and to separate by the difference of specific gravity through sedimentation.

It is preferable to use the mesophase pitch produced according to the above-mentioned sedimentation separation process than a pitch produced by a common process in the production process of the carbon fibers according to the present invention.

In carrying out infusiblization treatment and carbonization-graphitization treatment after melt-spinning of the above-mentioned mesophase pitch, spun pitch fibers are infusiblized continuously in an oxidative atmosphere at a temperature of 200°–400° C. at maximum, subsequently, infusiblized fibers are subjected to the first stage carbonization treatment in the atmosphere of an inert gas. It is most preferable in the present invention to use pitch fibers which are produced by using a nozzle having enlarged parts in the outlets of nozzle holes. The inert gas useful in the first stage carbonization treatment includes argon, helium, nitrogen, etc. Since fibers are extremely brittle from pitch fibers until the first stage carbonization, it is preferable to be treated under the state of practically no tension or under a tension of 1 mg/denier or less. The first stage carbonization is carried out usually at a temperature of 400°–1000° C. for 0.1–1.5 minutes. Resulting fibers are extremely tenacious carbon fibers having a tensile strength of 15–50 Kgf/mm$^2$, a tensile modulus of elasticity of 300–2,000 Kgf/mm $^2$ and an elongation of 0.3–8%, in which an interlayer spacing d 002 is 0.3460–0.3490 nm and a crystallite thickness $L_c$ (002) is 1.6–2.2 nm. More preferably, carbon fibers after the first stage carbonization having a tensile modulus of elasticity of 300–1,000 Kgf/mm$^2$, an interlayer spacing d 002 of 0.3465–0.3485 nm and a crystallite thickness $L_c$ (002) of 1.8–2.0 nm are useful in the present invention. In case of an interlayer spacing d 002 of smaller than 0.3460 nm, stretching of fibers becomes difficult in the second stage carbonization, and attainment of high modulus and high strength becomes difficult. Further in case of an interlayer spacing d 002 of greater than 0.3490 nm, it becomes difficult to apply a required amount of tension in the second stage of carbonization because break of monofilaments increases and it results in unpreferable graphitized fibers containing a large amount of fluffs.

The fibers having undergone the first stage carbonization, undergo the second stage carbonization. At this time, in order to prevent fluffs, it is possible to use processing oils, e.g. a surfactant, a silicone oil, an epoxy resin, a polyethylene glycol or a derivative of these materials, a mixture of 2 or more kinds of materials selected from the above-mentioned groups. A processing oil is caused to adhere to fibers as it is or in the state dissolved or dispersed in a solvent. Time of the second stage carbonization treatment varies from 0.1 to 10 minutes depending upon the purpose. Particularly important is control of tension at 50–300 mg/denier. To the fibers having a small interlayer spacing d 002 after the first stage carbonization, application of high tension is preferable for accomplishing higher modulus and higher strength. In case of tension lower than 50 mg/denier, it is difficult to accomplish higher modulus and tension over 300 mg/denier is not preferable because of the increase of fluffs.

The interlayer spacing d 002 was obtained by using a X-ray diffraction apparatus. Fibers were pulverized, a high purity silicon powder for X-ray standard grade was admixed to a specimen in an amount of 10% by weight as an internal standard and filled in a specimen cell. By X-ray diffractometer using CuK$\alpha$line as radiation source, 002 diffraction line of a sample and III diffraction line of standard silicon were measured. Calibrations for Lorenz polarization factor, atomic scattering factor and absorption factor were conducted and an angle of diffraction ($\theta$) of 002 line was obtained. Then, from the equation of $d=1.5418$ Å$/2\sin\theta$, the interlayer spacing d 002 was calculated. $L_c(002)$ could be obtained from the above-mentioned X-ray diffraction line, after calibration for $K\alpha_1$, $K\alpha_2$ doublet, calculating a half maximum width ($\beta$) of diffraction line of 002 and by using an equation of $L_c=9^1/\beta$ (Å).

The present invention will be described more fully by the following non-limitative examples. Percentage "%" is by weight unless otherwise indicated.

EXAMPLE 1

A distillate fraction of residual oil of thermal catalytic cracking (FCC) having an initial distillate of 450° C. and a final distillate of 560° C. was subjected to heat treatment at a temperature of 400° C. for 6 hours while introducing therein methane gas and further heat treatment at a temperature of 330° C. for 8 hours to grow mesophase and mesophase was separated by sedimentation utilizing the difference of specific gravity from nonmesophase pitch. This pitch contains 100% optically anisotropic phase, 65% pyridine insoluble portion and 87% toluene insoluble portion. After this pitch was subjected to melt spinning at a velocity of 270 m/min. by using a spinning nozzle having 1000 nozzle holes, outlet parts of which were enlarged, fibers were subjected to infusiblization on a net conveyor at a heating rate of 2° C./min., from 180° C. to 320° C. Similarly, on the net conveyor so as to give substantially tensionless state, the first stage carbonization was carried out in an inert atmosphere at a heating rate of 15° C./min. from 400° C. to 600° C. Resulting carbonized fibers after the first stage carbonization had following properties: 0.3485 nm of an interlayer spacing d 002, 0.8 nm of a crystallite thickness, 13 Kgf/mm$^2$ of a tensile strength and 500 Kgf/mm$^2$ of a tensile modulus of elasticity.

Resulting carbonized fibers were treated under the second stage carbonization condition of 2800° C. for 30 sec. in the atmosphere of argon and tension of 130 mg/denier to obtain carbon fibers. Resulting carbon fibers showed a tensile strength of 300 Kgf/mm$^2$ and a tensile modulus of elasticity of 83,000 Kgf/mm$^2$. When fluffs per 1 m were measured, they were found to be less than 10 per meter. Thus resulting fibers could be considered as superior fibers.

EXAMPLES 2 AND 3 AND COMPARATIVE EXAMPLE 1 AND 2

The infusiblized fibers of Example 1 were subjected to the first stage carbonization with an application of tension of 0.2–2.0 mg/denier and to the second stage carbonization under the condition the same with that of Example 1. Properties of fibers, number of fluffs of resulting carbon fibers are indicated in Table 1. The carbon fibers produced under the condition of the present invention contain few fluffs and a tensile strength and a tensile modulus of elasticity were very superior.

Those in which graphite crystallite had been developed more than a definite amount at the time of the first stage carbonization, and those which had undergone a tension of 1 mg/denier or more, showed poor physical properties or unstable production operation due to a large amount of fluffs.

TABLE 1

| | | Physical properties of first stage carbonized fibers | | Physical properties of second stage carbonized fibers | | |
|---|---|---|---|---|---|---|
| | First stage tension (mg/d) | Interlayer spacing d002 (nm) | Crystallite thickness $L_c(002)$ (nm) | Tensile strength (Kgf/mm$^2$) | Tensile modulus of elasticity (Kgf/mm$^2$) | Number of fluffs (m) |
| Example 1 | no tension | 0.3485 | 1.8 | 300 | 83,000 | less than 10 |
| Example 2 | 0.2 | 0.3478 | 1.8 | 302 | 83,000 | less than 10 |
| Example 3 | 0.7 | 0.3465 | 2.0 | 302 | 84,000 | less than 10 |
| Comparative example 1 | 1.5 | 0.3458 | 2.2 | 281 | 81,000 | more than 100 |
| Comparative example 2 | 2.0 | 0.3457 | 2.3 | production was impossible due to too much fluffs. | | |

EXAMPLES 4 AND 5 AND COMPARATIVE EXAMPLES 3 AND 4

The carbonized fibers of the first stage of Example 1 were subjected to the graphitization treatment in the second stage in the stream of argon with a tension of from 30 to 350 mg/denier at a temperature of 2800° C. for 30 second. Properties of resulting graphitized fibers are shown in Table 2.

As shown therein, graphitized fibers produced under the condition of the present invention of treatment, tension of 50 to 300 mg/denier contained few fluffs and were superior in a tensile strength and a tensile modulus of elasticity but those which were prepared under a condition outsides this range had a large number of fluffs and were poor in the aspect of physical properties.

TABLE 2

| | Second stage graphitization tension (mg/d) | Properties of graphitized fibers | | |
|---|---|---|---|---|
| | | Tensile strength ($Kgf/mm^2$) | Tensile modulus of elasticity ($Kgf/mm^2$) | Number of fluffs (m) |
| Comparative ex. 3 | 30 | 290 | 73,000 | less than 10 pieces |
| Example 4 | 80 | 315 | 82,000 | less than 10 pieces |
| Example 5 | 250 | 298 | 86,000 | less than 25 pieces |
| Comparative ex. 4 | 350 | 236 | 84,000 | more than 100 pieces |

EFFECTIVENESS OF THE INVENTION

The method for producing mesophase pitch-based carbon fibers, of the present invention enables to produce high strength and high modulus carbon fibers at a relatively low temperature and does not require such a high temperature that brings about rapid consumption of furnace elements and hence enables to continue stabilized production for a long period of time. Further resulting carbon fibers are those having a tensile strength of 250 $Kgf/mm^2$ or more and a tensile modulus of elasticity of 75,000 $Kgf/mm^2$ or more containing a small number of fluffs, and are superior in processability. It is expected to be used much more in future in the application field in space machineries and apparatus, rocket for transporting space machineries and apparatus, etc.

What is claimed is:

1. A method for producing mesophase pitch based carbon fibers which comprises carbonizing infusiblized fibers, obtained by treating mesophase-pitch-fibers, in an inert atmosphere under no tension or under a tension of 1 mg/denier or less in a first stage until an interlayer spacing d 002 of 0.3460–0.3490 nm and a crystallite thickness $L_c$ (002) of 1.6–2.2 nm are attained and then carbonizing under a tension of 50–300 mg/denier at the temperature of 2600° C. or more in the second stage.

* * * * *